US006373029B1

(12) United States Patent
Aragona

(10) Patent No.: US 6,373,029 B1
(45) Date of Patent: Apr. 16, 2002

(54) ENCLOSED COOKING SYSTEM

(76) Inventor: Guylaine R Aragona, 4 Brimstone Hill Rd., Amherst, NH (US) 03031

( * ) Notice: Subject to any disclaimer, the term of this patent is extended or adjusted under 35 U.S.C. 154(b) by 0 days.

(21) Appl. No.: 09/871,796

(22) Filed: Jun. 1, 2001

(51) Int. Cl.[7] ..... F24C 15/20; F24C 15/16; A21B 1/22; A21B 3/04; A21B 1/50

(52) U.S. Cl. ..... 219/393; 219/396; 219/400; 219/403; 219/409; 219/411; 99/340; 99/446; 126/21 R; 126/337 R

(58) Field of Search ..... 219/393, 395–397, 219/400, 403, 409, 411; 99/340, 444, 425, 446; 126/21 A, 21 R, 332, 337 R, 339

(56) References Cited

U.S. PATENT DOCUMENTS

| | | | | | |
|---|---|---|---|---|---|
| 3,303,839 | A | | 2/1967 | Tavan | 126/299 |
| 4,143,645 | A | | 3/1979 | Blumberg | 126/299 |
| 4,829,158 | A | * | 5/1989 | Burnham | 219/400 |
| 5,002,040 | A | | 3/1991 | MacFarlane | 126/299 |
| 5,042,456 | A | | 8/1991 | Cote | 126/299 |
| 5,272,317 | A | * | 12/1993 | Ryu | 219/403 |
| 5,308,956 | A | * | 5/1994 | Halters et al. | 219/400 |
| 5,676,870 | A | * | 10/1997 | Wassman et al. | 219/400 |
| 5,910,264 | A | * | 6/1999 | Dauliach | 219/411 |
| 5,938,959 | A | * | 8/1999 | Wang | 219/403 |
| 6,087,634 | A | * | 7/2000 | Cook et al. | 219/396 |
| 6,259,063 | B1 | * | 7/2001 | Lintner et al. | 219/400 |

FOREIGN PATENT DOCUMENTS

| | | | |
|---|---|---|---|
| CH | 630240 | * | 6/1982 |
| CH | 631802 | * | 8/1982 |
| GB | 1452266 | * | 10/1976 |

* cited by examiner

*Primary Examiner*—Joseph Pelham
(74) *Attorney, Agent, or Firm*—Goldstein Law Offices, P.

(57) ABSTRACT

An enclosed cooking system including a housing having a top wall, a bottom wall, a back wall, opposed side walls, and an open front. The bottom wall has a stove burner element positioned thereon. The stove burner element has a corresponding heating element. A ventilation fan is disposed within the top wall of the housing. The ventilation fan includes a replaceable filter slidably disposed within the top wall of the housing. A control panel is secured within the open front of the housing. The control panel is in communication with the heating element and the ventilation fan.

4 Claims, 2 Drawing Sheets

ENCLOSED COOKING SYSTEM

BACKGROUND OF THE INVENTION

The present invention relates to an enclosed cooking system and more particularly pertains to allowing food items to be prepared in a number of ways while eliminating odors and the like.

The use of stove ventilation devices is known in the prior art. More specifically, stove ventilation devices heretofore devised and utilized for the purpose of controlling cooking odors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,143,645 to Blumberg discloses a self-contained exhaust hood for removing air from a work area, such as cooking smoke and odors. U.S. Pat. No. 5,042,456 to Cote discloses a ventilation system comprised of a fan and filter for use with cooking systems. U.S. Pat. No. 3,303,839 to Tavan and U.S. Pat. No. 5,002,040 to MacFarlane disclose additional means for ventilating air from a cooking unit.

While these devices fulfill their respective, particular objective and requirements, the aforementioned patents do not describe an enclosed cooking system for allowing food items to be prepared in a number of ways while eliminating odors and the like.

In this respect, the enclosed cooking system according to the present invention substantially departs from the conventional concepts and designs of the prior art, and in doing so provides an apparatus primarily developed for the purpose of allowing food items to be prepared in a number of ways while eliminating odors and the like.

Therefore, it can be appreciated that there exists a continuing need for a new and improved enclosed cooking system which can be used for allowing food items to be prepared in a number of ways while eliminating odors and the like. In this regard, the present invention substantially fulfills this need.

SUMMARY OF THE INVENTION

In the view of the foregoing disadvantages inherent in the known types of stove ventilation devices now present in the prior art, the present invention provides an improved enclosed cooking system. As such, the general purpose of the present invention, which will be described subsequently in greater detail, is to provide a new and improved enclosed cooking system which has all the advantages of the prior art and none of the disadvantages.

To attain this, the present invention essentially comprises a housing having a generally rectangular configuration. The housing has a top wall, a bottom wall, a back wall, opposed side walls, and an open front. The housing has a light source disposed therein. The bottom wall has a stove burner element positioned thereon. The stove burner element has a corresponding heating element. The opposed side walls each have a plurality of corresponding brackets secured on interior surfaces thereof. A ventilation fan is disposed within the top wall of the housing. The ventilation fan includes a replaceable filter slidably disposed within the top wall of the housing. A grilling element is slidably positioned between the corresponding brackets of the opposed side walls of the housing. The grilling element is connectable with the heating element. The grilling element includes a drip pan slidably positioned between the corresponding brackets of the opposed side walls of the housing below the grilling element. A control panel is secured within the open front of the housing. The control panel is in communication with the heating element and the ventilation fan.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved enclosed cooking system which has all the advantages of the prior art stove ventilation devices and none of the disadvantages.

It is another object of the present invention to provide a new and improved enclosed cooking system which may be easily and efficiently manufactured and marketed.

It is a further object of the present invention to provide a new and improved enclosed cooking system which is of durable and reliable construction.

An even further object of the present invention is to provide a new and improved enclosed cooking system which is susceptible of a low cost of manufacture with regard to both materials and labor, and which accordingly is then susceptible of low prices of sale to the consuming public, thereby making such an enclosed cooking system economically available to the buying public.

Even still another object of the present invention is to provide a new and improved enclosed cooking system for allowing food items to be prepared in a number of ways while eliminating odors and the like.

Lastly, it is an object of the present invention to provide a new and improved enclosed cooking system including a housing having a top wall, a bottom wall, a back wall, opposed side walls, and an open front. The bottom wall has a stove burner element positioned thereon. The stove burner element has a corresponding heating element. A ventilation fan is disposed within the top wall of the housing. The ventilation fan includes a replaceable filter slidably disposed within the top wall of the housing. A control panel is secured within the open front of the housing. The control panel is in communication with the heating element and the ventilation fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
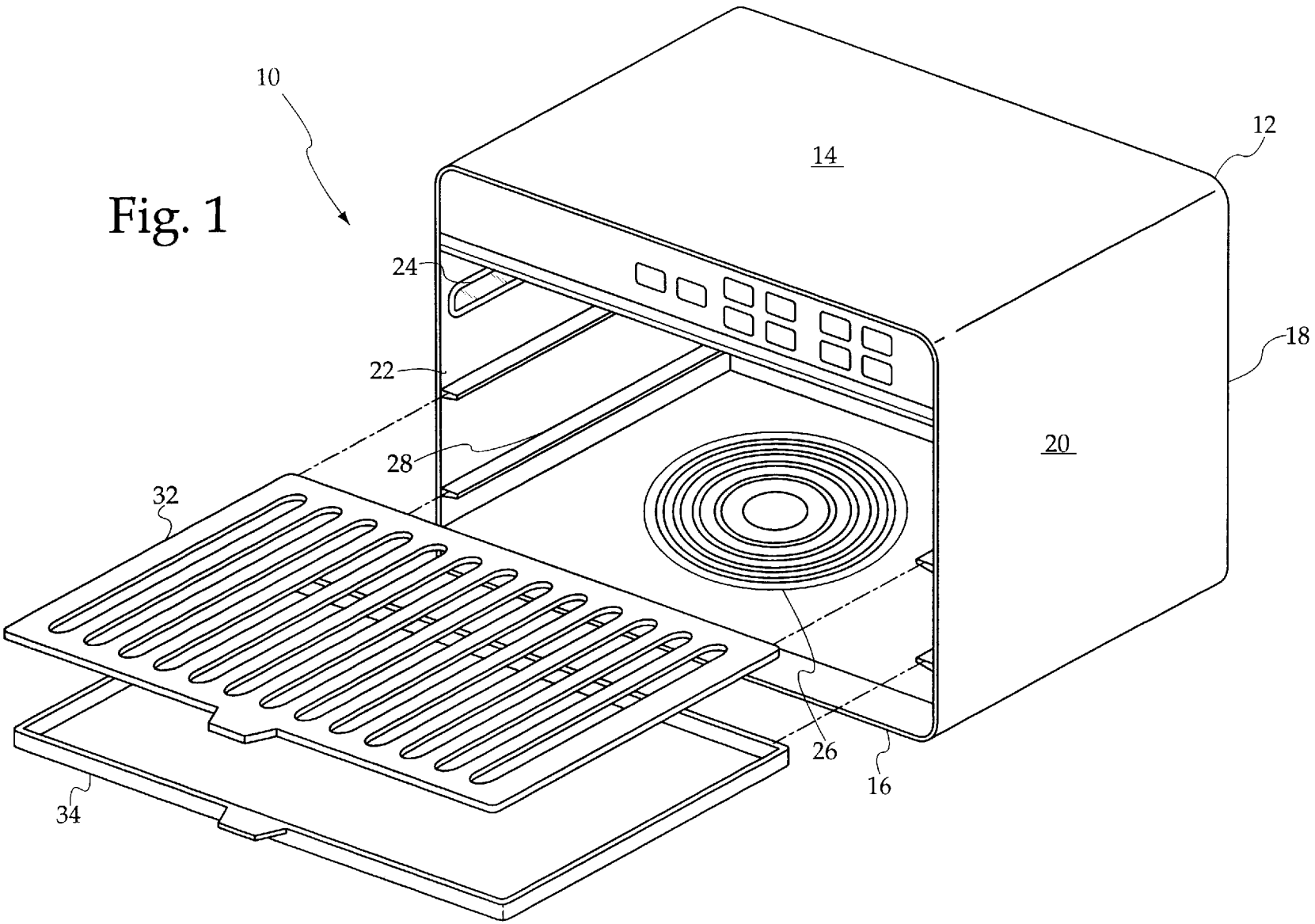
FIG. 1 is a perspective view of the preferred embodiment of the enclosed cooking system constructed in accordance with the principles of the present invention.
Figure 2:
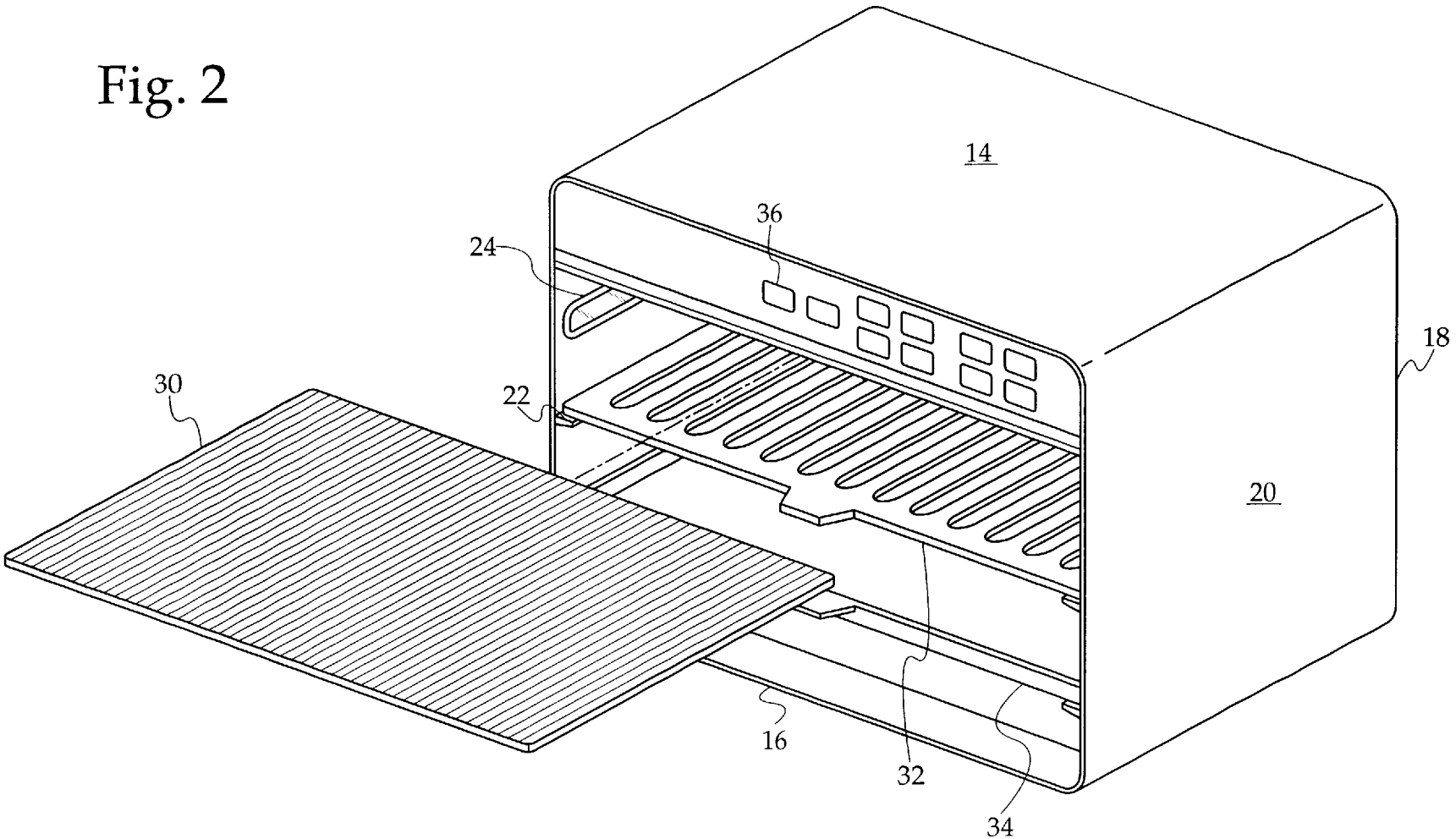
FIG. 2 is a perspective view of the present invention illustrating removal of the air filter therefrom.

With reference now to the drawings, and in particular, to FIGS. 1 through 2 thereof, the preferred embodiment of the new and improved enclosed cooking system embodying the principles and concepts of the present invention and generally designated by the reference number 10 will be described.

Specifically, it will be noted in the various Figures that the device relates to an enclosed cooking system for allowing food items to be prepared in a number of ways while eliminating odors and the like. In its broadest context, the device consists of a housing, a ventilation fan, a grilling element, and a control panel. Such components are individually configured and correlated with respect to each other so as to attain the desired objective.

The housing 12 has a generally rectangular configuration. The housing 12 has a top wall 14, a bottom wall 16, a back wall 18, opposed side walls 20, and an open front 22. The housing 12 has a light source 24 disposed therein. In the preferred embodiment, the light source 24 will be automatically activated once the present invention is in use. The bottom wall 18 has a stove burner element 26 positioned thereon. The stove burner element 26 has a corresponding heating element. The opposed side walls 20 each have a plurality of corresponding brackets 28 secured on interior surfaces thereof.

The ventilation fan is disposed within the top wall 14 of the housing 12. The ventilation fan is similar in operation to standard fans utilized in stoves and microwaves. Thus, an illustration of the ventilation fan has been omitted. The ventilation fan includes a replaceable filter 30 slidably disposed within the top wall 14 of the housing 12. An opening in the housing 12 will allow the filter 30 to slide in above the ventilation fan. Thus, when the ventilation fan is activated, the odors from cooking will be sucked up and absorbed by the filter 30. After continued use, the filter 30 can be removed and replaced or cleaned.

The grilling element 32 is slidably positioned between the corresponding brackets 28 of the opposed side walls 20 of the housing 12. The grilling element 32 is connectable with the heating element. Alternately, the grilling element 32 could be provided with a male plug on its leading edge that will connect with a corresponding female plug on the back wall 18 of the housing 12. The grilling element 32 includes a drip pan 34 slidably positioned between the corresponding brackets 28 of the opposed side walls 20 of the housing 12 below the grilling element 32. The drip pan 34 will collect any grease and food particles that will fall through the grilling element 32 during cooking. Both the grilling element 32 and the drip pan 34 can be easily removed from the housing 12 to be cleaned or to use the stove burner element 26.

The control panel 36 is secured within the open front 22 of the housing 12. The control panel 36 is in communication with the heating element and the ventilation fan. The user simply presses a series of buttons or knobs of the control panel 36 in order to control operation of the present invention, namely the degree of heat generated by the heating element and the speed of the ventilation fan.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An enclosed cooking system for allowing food items to be prepared in a number of ways while eliminating odors and the like comprising, in combination:

a housing having a generally rectangular configuration, the housing having a top wall, a bottom wall, a back wall, opposed side walls, and an open front, the housing having a light source disposed therein, the bottom wall having a stove burner element positioned thereon, the stove burner element having a corresponding heating element, the opposed side walls each having a plurality of corresponding brackets secured on interior surfaces thereof;

a ventilation fan disposed within the top wall of the housing, the ventilation fan including a replaceable filter slidably disposed within the top wall of the housing;

a grilling element slidably positioned between the corresponding brackets of the opposed side walls of the housing, the grilling element being connectable with the heating element, the grilling element including a drip pan slidably positioned between the corresponding brackets of the opposed side walls of the housing below the grilling element; and a control panel secured within the open front of the housing, the control panel being in communication with the heating element and the ventilation fan.

2. An enclosed cooking system for allowing food items to be prepared in a number of ways while eliminating odors and the like comprising, in combination:

a housing having a top wall, a bottom wall, a back wall, opposed side walls, and an open front, the bottom wall having a stove burner element positioned thereon, the stove burner element having a corresponding heating element;

a ventilation fan disposed within the top wall of the housing, the ventilation fan including a replaceable filter slidably disposed within the top wall of the housing; and a control panel secured within the open front of the housing, the control panel being in communication with the heating element and the ventilation fan.

3. The enclosed cooking system as set forth in claim 2, wherein the housing has a light source disposed therein.

4. The enclosed cooking system as set forth in claim 2, and further including a grilling element slidably positioned between the opposed side walls of the housing, the grilling element being connectable with the heating element, the grilling element including a drip pan slidably positioned between the opposed side walls of the housing below the grilling element.

* * * * *